United States Patent [19]

Brockhaus

[11] Patent Number: 4,542,558

[45] Date of Patent: Sep. 24, 1985

[54] UNHINGEABLE DOOR HINGE JOINT HAVING A HINGE PIN WITH A NONROTATABLE PORTION AND A RELATIVELY ROTATABLE PORTION

[75] Inventor: Ernst Brockhaus, Remscheid-Hasten, Fed. Rep. of Germany

[73] Assignee: Fa. ED. Schwarächter GmbH & Co. KG, Remscheid, Fed. Rep. of Germany

[21] Appl. No.: 418,373

[22] Filed: Sep. 15, 1982

[30] Foreign Application Priority Data

Sep. 18, 1981 [DE] Fed. Rep. of Germany ..... 3137112
Feb. 10, 1982 [DE] Fed. Rep. of Germany ..... 3204606

[51] Int. Cl.[4] ..... E05D 7/10

[52] U.S. Cl. ..... 16/263; 16/380; 16/386; 16/DIG. 40

[58] Field of Search ..... 16/261, 262, 263, 265, 16/270, 273, 342, 380, 386, DIG. 27, DIG. 40, DIG. 41

[56] References Cited

U.S. PATENT DOCUMENTS

| | | | |
|---|---|---|---|
| 595,789 | 12/1897 | Smith | 16/342 X |
| 1,012,162 | 12/1911 | Roper | 16/374 |
| 1,350,360 | 8/1920 | Crane | 16/374 |
| 1,392,561 | 10/1921 | Duffy | 16/380 X |
| 3,015,126 | 1/1962 | Ahlgren | 16/386 |
| 3,209,391 | 10/1965 | Mangini | 16/75 |
| 3,448,486 | 6/1969 | Wright | 16/386 X |

FOREIGN PATENT DOCUMENTS

| | | | |
|---|---|---|---|
| 1459104 | 11/1968 | Fed. Rep. of Germany | 16/386 |
| 2017581 | 11/1971 | Fed. Rep. of Germany | 16/386 |
| 2534024 | 2/1976 | Fed. Rep. of Germany | 16/342 |
| 21793 | of 1900 | United Kingdom | 16/DIG. 40 |

*Primary Examiner*—Fred A. Silverberg
*Attorney, Agent, or Firm*—Toren, McGeady, Stanger, Goldberg & Kiel

[57] ABSTRACT

A door hinge assembly which facilitates fitting and aligning of a door particularly in motor vehicles, including a first and a second hinge member each having, respectively, a first and a second eye with a hinge pin being engaged within the eyes of the hinge members to operatively mount the hinge members together. The hinge pin is mounted so as to be freely rotatable relative to the first eye, but secured against axial movement relative thereto. The hinge pin is shaped so that it will engage a part of the second eye so as to be nonrotatable relative thereto, with the portion of the hinge pin thus shaped having alignment faces which engage complementary faces on the second hinge eye which are directed diagonally relative to the hinge axis.

15 Claims, 10 Drawing Figures

FIG. 5
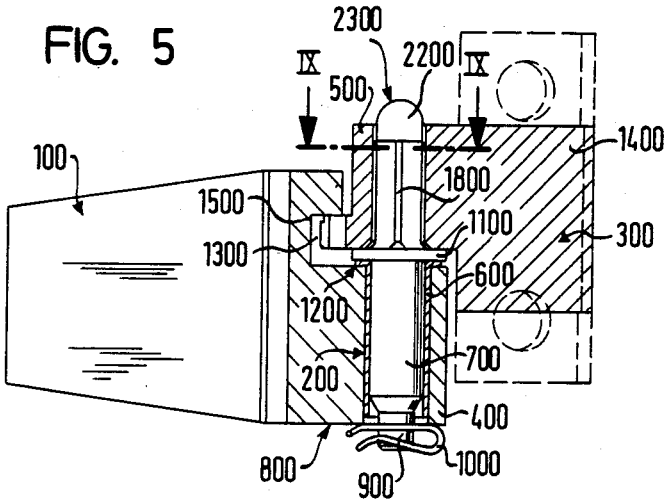
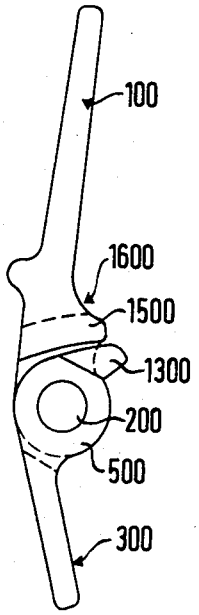
FIG. 7
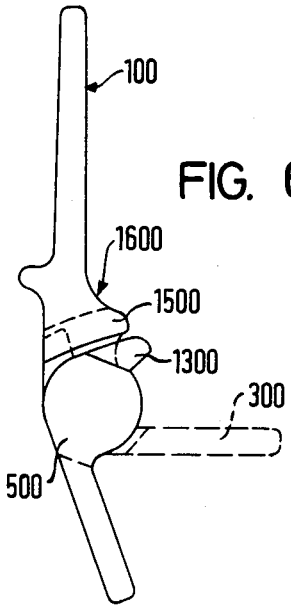
FIG. 6
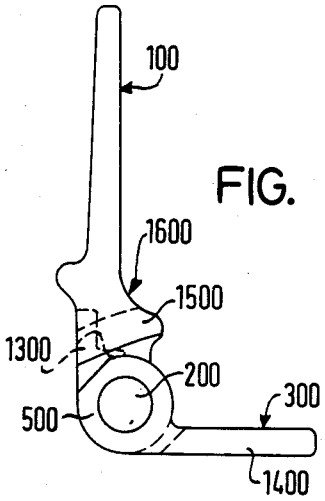
FIG. 8
FIG. 9
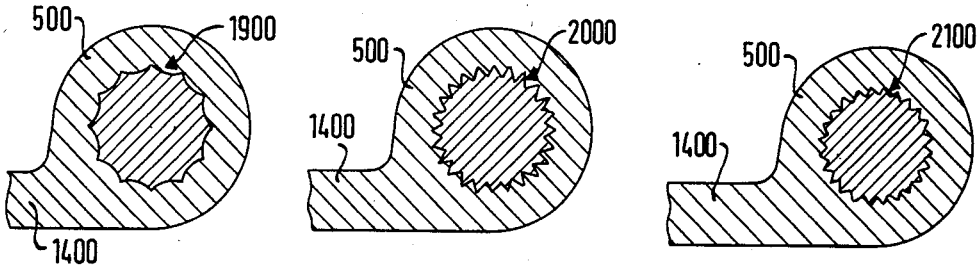

UNHINGEABLE DOOR HINGE JOINT HAVING A HINGE PIN WITH A NONROTATABLE PORTION AND A RELATIVELY ROTATABLE PORTION

The present invention relates generally to door hinge assemblies, and particularly to assemblies which are especially suitable for use in mounting doors on motor vehicles.

Door hinges of this type which enable unhinging of the assembly during door mounting, are employed in modern production facilities for automobiles in order to enable appropriate fitting and adjustment of unfinished doors in the body of the automobile and to then enable them to be removed from the body during assembly and outfitting of the automobile.

This achievement is made possible in that, on the one hand, both halves of the door hinge on the respective door part or post are attached and securely fastened in position so that when the door is again inserted or mounted on the automobile body, the door will be fitted in exact alignment with the door opening formed in the body of the vehicle. Furthermore, an advantage is achieved in that assembly and outfitting of the automobile may be performed substantially faster and with greater ease when the doors are removed.

Door assemblies of the type which may be unhinged during mounting and which may be used for doors in buildings or in connection with furniture wherein a hinge pin is non-rotatably connected with one of the hinge parts are known. In such assemblies, the one hinge part with which the pin is non-rotatably connected may be fastened either on the part of the door, or on the door post and a sleeve which may be attached to the hinge pin is connected with the other hinge part. However, in door hinges for buildings or furniture, different conditions arise as compared with door hinges for motor vehicles, and such hinges are not comparable because, on the one hand, they are subjected to generally different stresses and furthermore, they are operated under totally different environmental conditions which are usually fairly constant and which therefore makes it possible to permit larger tolerances and simpler production techniques.

Accordingly, the present invention is directed toward provision of a door assembly of the type described above which is particularly suitable for mounting motor vehicle doors and which, with advantageous production and assembly expenditures and possibly with automatic compensation of misalignment of parts will permit during assembly restoration of the automobile doors which are initially adjusted to the body shell of the automobile into their originally adjusted position during a subsequent or second assembly step. Furthermore, the arrangement of the invention will also enable this achievement without requiring special work expenditure or special technical devices and will permit the door to be secured against unintentional unhinging throughout its operational pivoting angle or range.

SUMMARY OF THE INVENTION

Briefly, the present invention may be described as a door hinge assembly particularly for motor vehicle doors comprising a first hinge member having a first hinge eye, a second hinge member having a second hinge eye, a hinge pin including an axis engaged within said eyes of said first and second hinge members, said hinge pin being mounted to be freely rotatable relative to said first eye but secured against axial movement relative thereto, and engagement means interposed between said hinge pin and said second eye to maintain said hinge pin and said second eye in nonrotative relative engagement with each other, said engagement means comprising a shaped portion of said hinge pin and a complementary shaped portion of said second eye, with at least the shaped portion of said hinge pin having alignment faces engaging said complementary shaped portion of said second eye which are directed diagonally relative to said hinge axis.

Accordingly, the principal objects of the invention are met in that the hinge pin is connected in a nonrotatable manner with the attachable or second hinge eye by means of a shaped portion of at least a part of the hinge pin, which shaped portion operates to effect locking engagement with the hinge eye. In accordance with the invention, at least the shaped portion of the hinge pin should have aligning surfaces which are directed diagonally relative to the axis of the hinge or pin for engaging the countershaped or complementary portions in the hinge eye of the other hinge member.

It is possible with such a door hinge assembly to irremovably fasten the one hinge half supporting the hinge pin in alignment corresponding to the adjustment position of the door, particularly by means of welding onto a door part, particularly a door frame. Also, it is possible at the same time to fasten the other hinge half on the other door arrangement or part also irremovably so that the position of the hinge axis corresponding to the adjustment position of the motor door is irremovably fixed or ready in the shell or unfinished state of the motor vehicle body. With respect to the high stress of the door hinge which is assumed for motor vehicle door hinges, it is of particular advantage that the hinge construction in accordance with the invention involves a hinge pin in one hinge half which is supported with running fit in an accurately adjusted position from the very beginning while cooperating in a locking manner with the other attachable hinge half.

In a more specific structural embodiment of the invention, the engagement means on the hinge pin are embodied in a radially extending flange on the hinge pin which is formed with a tapered collar which constitutes the shaped portion of the hinge pin having the alignment faces thereon. The second eye is formed with a chamfer adapted to mate with the tapered collar on the flange.

Thus, in each instance, the hinge pin and the hinge eye of one of the hinge halves are provided with radially directed, alternately arranged projections and recesses at least over part of their length, which projections and recesses engage in one another. In the simplest case, the alternately arranged, radially directed projections and recesses engaging in one another when the door is hinged may be arranged in a horizontal plane, instead of on a tapered collar, on any desired position of the length of the hinge pin located above the hinge eye of the first hinge member with which the hinge pin is rotatably connected.

In accordance with a first embodiment of the invention, the hinge pin is rotatably supported in the first hinge member and is provided with the radially projecting flange overlapping the upper face of the second hinge eye. The flange is provided with the tapered collar having radially directed ribs or grooves, or projections and recesses, respectively, on its upper side to which an identically shaped radially directed chamfer or tapered surface on the end of the second hinge eye is provided. It is of particular importance here that the shaped tapered collar of the hinge pin be formed with a conical toothed configuration and that the mating portion of the second hinge eye be formed so as to incline with a corresponding direction so that the flank faces of the ribs and grooves or projections and recesses of the radially directed shaped portions of the flange as well as the shaped portions of the face of the hinge pin engaging the flange be arranged so as to incline toward one another in the manner of an acute angle.

This arrangement has the special advantage that when the door is hinged, an automatic mutual alignment of the two shaped portions of the assembly is effected such that the shaping of the mating face of the second hinge eye slides onto the shaped collar or upper side of the flange on the hinge pin, wherein the hinge pin is rotated a corresponding amount, as the case may be, in its bearing in the hinge eye of the first hinge member.

In accordance with a further embodiment of the invention, it is provided that the upper side of the flange of the hinge pin be formed with a rounded or spherical shape and that the mating face of the hinge eye be cup-shaped to receive therein the rounded or spherically shaped portion of the hinge pin, wherein the shaped upper side of the hinge pin flange and the mating face of the hinge eye are formed according to the spatial form of the two parts. In this connection, in accordance with the invention, the diameter of the hinge pin in the area of its length rising above the flange is dimensioned smaller than the bore hole diameter of the second hinge eye by an amount sufficient to permit adjustment play so that the hinge eye of the second hinge half or member may be supported with its axis at a certain angle to the axis of the hinge pin on the collar or flange of the hinge pin, which flange contacts the upper face of the first hinge eye. It is thereby possible to compensate for small misalignments between the upper and lower door hinge members of a motor vehicle door during fitting of the door in the body shell.

In connection with this embodiment of the invention, if the hinge assembly is further provided so that the upper area of the hinge pin reaches through the hinge eye of the second hinge member and rises above it to the top thereof, a securing member may be supported on the upper front face of the hinge eye of the second hinge member, which securing member engages or reaches through the hinge pin and is assigned to the hinge pin.

In order to ensure easy hinging and unhinging of the motor vehicle door in a maintenance-free bearing of the hinge pin as well as to ensure that the motor vehicle door will not be unintentionally lifted out of its suspension in the hinge assembly when it is moved through its operational pivoting angle or range, an additional embodiment of the invention provides that by a specific combination of structural features, one hinge half is prevented from being axially disconnected from the other hinge half throughout the range of the pivoting angle of the door.

In this embodiment, the hinge pin is permanently connected with the first hinge eye by means of a bushing composed of bearing material so as to be freely rotatable and secured against axial movement relative to the first eye in a maintenance-free manner. The hinge pin engages in a sliding manner in the second hinge eye, and the second hinge eye is formed with the corresponding mating surface which engages the shaped portion of the hinge pin by means of an axially straight, radially directed circumferential shaped portion so as to be unsecured in the axial direction. The two hinge halves are locked with one another in the axial direction only over a predetermined operational pivoting angle or range by means of reciprocally arranged projections and recesses defined in the circumferential direction and engaging in one another over the operational pivoting angle or range of the hinge assembly. Thus, throughout the ordinary pivoting range of the hinge, the projections and recesses of the assembly will be in engagement to prevent axial disconnection of the hinge and only when the one hinge half is moved or pivoted angularly beyond the pivoting range is it possible to disassemble the hinge.

The axial locking of the two hinge halves effective over the entire operational pivoting angle or range of the hinge ensures that the hinge cannot be unintentionally unhinged or separated during any of its normal operational positions.

In order to facilitate the hinging installation of a motor vehicle door, it is provided that part of the hinge pin engaging in the removable hinge half, which part adjoins a cylindrical forward or initial guiding area, has an area provided with a circumferential shaped portion and the hinge eye of the unhingable hinge half has a correspondingly shaped eye bore hole. It is preferable that the upper end of the cylindrical forward guiding area of the hinge pin be shaped with a rounded head and that it have a smaller diameter as a whole than the eye bore hole in the hinge eye of the unhingable hinge half in such a manner that the forward guiding area achieves engagement with and guides the hinge eye of the unhingable hinge half even when the door is attached on the hinge pin in an inaccurate manner. The reciprocally arranged projections and grooved recesses serving for interlocking of the two hinge halves are preferably arranged in such a manner that the radially directed projection is always arranged on the hinge eye of one of the hinge halves and that the appertaining grooved recess is always arranged outside of the area of its hinge eye on the hinge wing blade of the other hinge half. A grooved recess in the hinge wing blade of the other hinge half may be assigned with a radial directed projection arranged on the hinge eye of the unhingable hinge half, which projection extends over a part of the height of the hinge eye and which, with the hinge wing blade, will enclose an angle. However, a reverse arrangement may also be provided wherein a radial projection on the hinge eye of the hinge half which is to be permanently fastened on the motor vehicle is assigned to a grooved recess provided outside of the area of the hinge eye on the hinge wing blade of the unhingable hinge half.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings

FIG. 5 is a partially cut away side view of a hinge assembly at its maximum operational opening position;

FIG. 6 is a top view of FIG. 5;

FIG. 7 is a top view of an assembly similar to that of FIG. 6 but with one hinge half swung beyond its operational pivoting angle;

FIG. 8 is a top view of a hinge assembly in accordance with FIGS. 6 and 7 wherein the hinge halves are in a position corresponding to the closed position of the door;

FIG. 9 is a partial sectional representation taken along the line IX—IX in FIG. 6 showing a different embodiment of the invention in an enlarged scale.

DETAILED DESCRIPTION OF THE PREFERRED EMBODIMENTS

Figure 1:
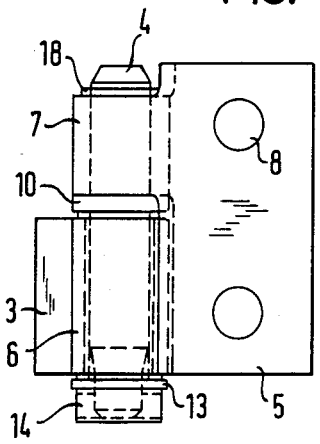
FIG. 1 is a side view of a motor vehicle door hinge assembly in accordance with the invention.
Figure 2:
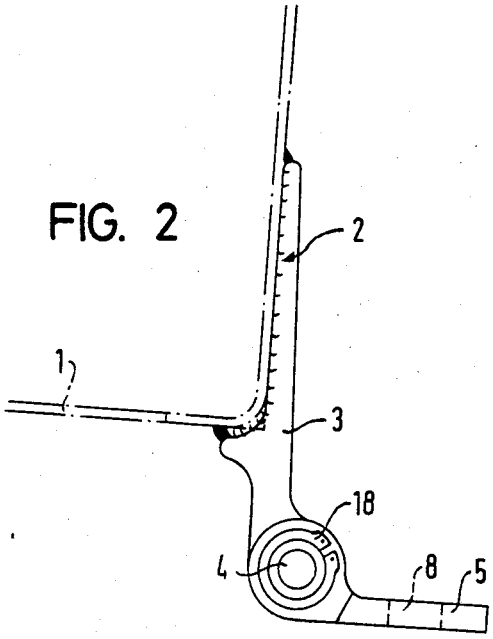
FIG. 2 is a top view of the assembly of FIG. 1.
Figure 3:
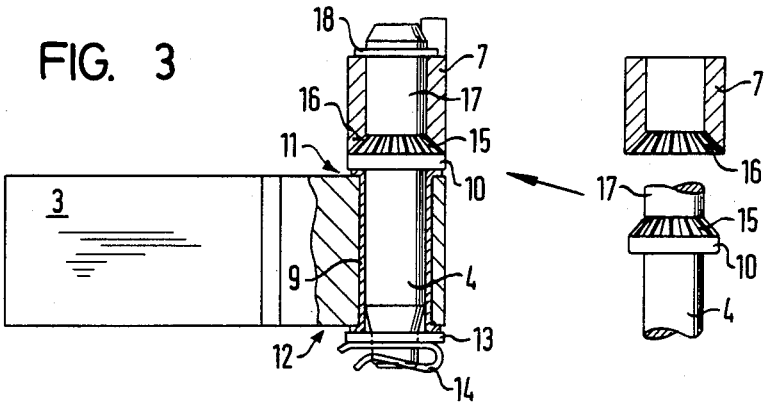
FIG. 3 is a partial longitudinal sectional view taken through the assembly of FIGS. 1 and 2.

Referring now to the drawings, and particularly to FIGS. 1, 2, and 3, a hinge assembly in accordance with the present invention particularly suitable for use with a motor vehicle door is shown as comprising a first hinge half or member 3 fastened upon a door part 1 by means of welding beads 2 with a second hinge half or member 5 being connected with the first hinge member 3 by a hinge pin 4. The hinge pin 4 extends through a first hinge eye 6 in the first hinge member 3 and through a second hinge eye 7 in the second hinge member 5. The second hinge member 5 is provided with two openings or holes 8 for fastening screws.

The hinge pin 4 is supported with a running fit so as to be freely rotatable within the first hinge member 3 by means of a bearing bush which is composed of maintenance-free bearing material and which is formed as a collar bush 9. The hinge pin 4 is secured against migration or movement in the axial direction relative to the first hinge eye 6 by means of a radially projecting flange 10 formed on one side thereof which overlaps an upper face 11 of the first hinge eye 6. On the other end of the hinge pin 4 there is provided a spring clip 14 located below a lower face 12 of the first hinge eye 6 by which the hinge pin is axially secured through the intermediary of a washer 13.

On the upper side of the flange 10 there is provided a collar 15 which is formed with a tapered or frustoconical configuration and upon which there are formed alternating consecutive projections, teeth, or ribs as well as recesses or grooves. The collar 15 is formed as a frustoconical toothed annular surface which is directed radially and which is essentially in a truncated conical form. The flank faces of the projections or ribs and of the recesses or grooves together enclose an acute angle in each instance. The lower face of the hinge eye 7 of the hinge half 5 is formed with an identical radially directed chamfer 16 which, however, forms a countersurface for the frustoconical collar 15. The hinge pin 4 extends through the hinge eye 7 of the hinge half 5 and a portion 17 thereof rises above the flange 10 and above the collar 15 so that it may be secured at its upper side by means of a securing member 18.

Figure 4:
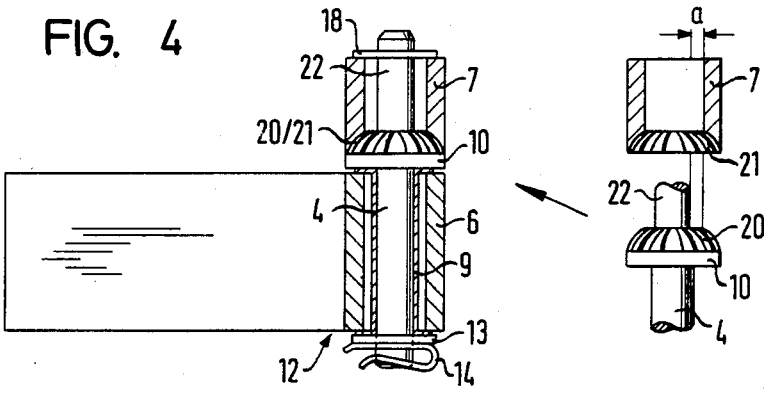
FIG. 4 is a partial longitudinal sectional view taken through another embodiment of an assembly in accordance with the invention.
Figure 10:
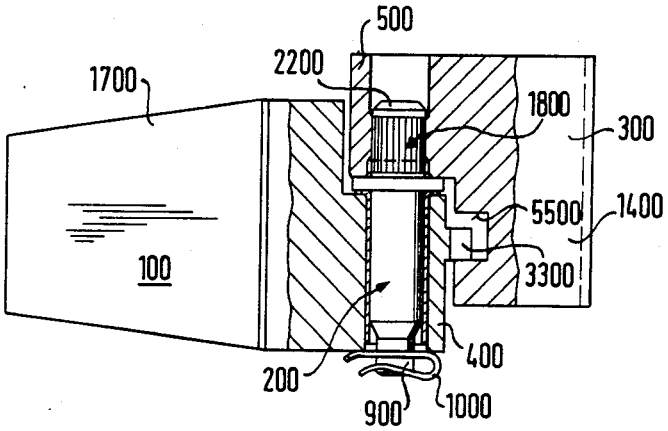
FIG. 10 is a partially cut away side view of a further embodiment of a hinge assembly in accordance with the present invention shown at its maximum operational opening position.

Another embodiment of the invention is shown in FIG. 4 wherein the upper side of the flange 10 of the hinge pin 4 is formed with a spherical configuration and is provided with a spherical, radially directed collar 20 composed of alternating consecutive projections and recesses.

The lower face of the hinge eye 7 of the second hinge member 5 is formed with a cup-shaped configuration and is likewise provided with a chamfer 21 formed with alternating consecutive projections and recesses with the chamfer 21 following the cup-shape of the lower face of the hinge eye 7. The length 22 of the hinge pin 4 extending above the flange 10 is formed with a diameter which is smaller than the diameter of a bore hole in the hinge eye 7 by a sufficiently dimensioned amount of play a.

Further embodiments of the invention are shown in FIGS. 5 through 10 wherein each of the door hinge assemblies is formed to comprise a first hinge member 100 and a second hinge member 300 connected together by means of a hinge pin 200, wherein the hinge pin 200 extends through a first hinge eye 400 of the first hinge member 100 and a second hinge eye 500 of the second hinge member 300. The hinge pin 200 is rotatably supported in the first hinge eye 400 of the first hinge member 100 by means of a bush 600 composed of bearing material which extends over a cylindrical section 700 with the pin being affixed against axial movement by means of a spring clip 1000 supported on the lower face 800 of the first hinge eye 400. The spring clip 1000 engages a peg-shaped extension 900 of the hinge pin 200.

On the opposite side, the hinge pin 200 is secured against axial migration by means of a radially directed disc or flange 1100 which contacts the upper face 1200 of the hinge eye 400.

In the embodiment shown in FIG. 5, the hinge eye 500 is provided with a radially directed projection 1300 which encloses an angle taken in top view with the hinge wing blade 1400 of the hinge member 300. The radially directed projection 1300 on the hinge eye 500 of the second hinge member 300, which projection 1300 is approximately in the form of a nose or protuberance, engages in a grooved recess 1500 of the first hinge half 100 when the door is attached with the hinge, as will be seen in FIGS. 5 and 6 as well as in FIG. 8. The grooved recess 1500 is curved with an arcuate shape and is formed by means of a cutout section in an enlarged area 1600 of the hinge wing blade 1700 of the first hinge member 100.

The grooved recess 1500 is open at both ends and has a length which ensures that the projection 1300 on the hinge eye 500 of the hinge member 300 is engaged with the door hinge only over the operating pivotal angular range of the door hinge. If the door or the hinge, respectively, swings in the opening direction beyond the operational pivoting angular range after elimination of mechanical obstacles from other quarters, in particular, after the door arrester or holder is unhinged, then the projection 1300 of the hinge eye 500 disengages with the grooved recess 1500 on the hinge member 100, and the hinge member 300 may be removed by movement thereof in the axial direction off the hinge pin 200. When the hinge eye 500 is attached on the hinge pin 200, the hinge member 300 is locked with the hinge pin 200 in a nonrotatable manner relative thereto and in a locking manner whereby for this purpose the hinge pin 200 is provided with radially directed circumferential teeth 1800 over at least a part of the length thereof engaging in the hinge eye 500.

The circumferential teeth 1800 of this part of the hinge pin 200, as will be seen from FIG. 9, may be shaped either with a waved formation as indicated at 1900 or with a toothed shape as indicated at 2000 or with a knob-like configuration as indicated at 2100. The inner circumference of the bore hole in the hinge eye 500 is shaped in a manner corresponding to the circumferential shaping of the hinge pin 200 in such a manner that a locking engagement between the hinge pin 200 and the hinge eye 500 is effected when the hinges are in the hinged position. The hinge pin 200 has a cylindrical forward guide 2200 forwardly of the teeth 1800 which is provided with a circumferential collar, the diameter of the forward guide 2200, as will be seen particularly from FIG. 5, being smaller than the maximum width of the bore hole of the hinge eye 500. In the embodiment depicted in FIG. 10, the hinge eye 400 of the hinge member 100 fastened onto the motor vehicle is provided with a radially directed projection 3300 which, in top view, is shown as corresponding to the projection 1300 in the hinge shown in FIGS. 5–8.

A grooved recess 5500 in the hinge wing blade 1400 of the hinge member 300 is assigned to the radial projection 3300 on the hinge eye 400 of the hinge member 100.

Thus, in accordance with the present invention, a door hinge for a motor vehicle may be provided with a first and a second hinge member as well as with a hinge pin engaging in the hinge eyes of the hinge members so as to be freely rotatable along a part of its length in the hinge eye of one of the hinge members. As a result of the attachment of the pin in the one hinge member, it is ensured along with the possibility of easy unhinging and hinging of the door with a maintenance-free bearing of the hinge pin, that the door cannot be unintentionally unhinged over its operational pivoting angular range. For this purpose, the hinge pin is secured against axial migration in the axial direction and permanently supported in a hinge eye so as to be freely rotatable and engages in a correspondingly shaped countersurface of the other hinge eye by means of an axially directed circumferential collar with both hinge members being locked with one another and in the axial direction only over a predetermined operational pivoting angular range by means of reciprocally arranged projections and recesses.

While specific embodiments of the invention have been shown and described in detail to illustrate the application of the inventive principles, it will be understood that the invention may be embodied otherwise without departing from such principles.

What is claimed is:

1. A door hinge assembly particularly for motor vehicle doors comprising a first hinge member having a first hinge eye, a second hinge member having a second hinge eye, a hinge pin consisting essentially of a single continuous longitudinal member defining an axis engaged within said eyes of said first and second hinge members, respectively, along different portions of its length, said hinge pin being mounted to be freely rotatable relative to said first eye and secured against axial movement relative thereto with said second hinge eye being adapted to allow axial movement thereof relative to said hinge pin in order to enable mounting and dismounting of said second hinge member on and from said hinge pin, and engagement means interposed between said hinge pin and said second eye to maintain said hinge pin and said second eye in nonrotative relative engagement with each other when said second hinge member is mounted on said hinge pin without impeding axial movement of said second hinge eye relative to said hinge pin when said second hinge member is dismounted therefrom, said engagement means comprising a shaped portion of said hinge pin and a complementary shaped portion of said second eye, with at least the shaped portion of said hinge pin having alignment faces engaging said complementary shaped portions of said second eye to effect said nonrotative relative engagement between said hinge pin and said second hinge eye, said alignment faces being directed radially relative to said hinge axis.

2. An assembly according to claim 1 wherein said engagement means comprise a flange extending radially from said hinge pin and wherein said shaped portion of said hinge pin comprises a frustoconical collar on said flange with said complementary shaped portion of said second eye comprising a chamfer in the bore of said second eye within which said hinge pin is received, said chamfer engaging said frustoconical collar to prevent relative rotation between said hinge pin and said second eye.

3. An assembly according to claim 2 wherein said hinge pin comprises means at one end thereof fastening said hinge pin against axial movement relative to said first eye, said first eye being axially held between said fastening means and said flange.

4. An assembly according to claim 2 wherein said flange of said hinge pin overlaps an end face of said first hinge eye and wherein said collar is provided on the upper side of said flange and is formed with radially directed projections and recesses, said end face of said second hinge eye having identically shaped radially directed complementary elements.

5. An assembly according to claim 4 wherein said projections and said recesses formed respectively in said collar and in said chamfer are arranged respectively to one another in acute angles.

6. An assembly according to claim 2 wherein said collar of said flange is formed in the shape of a conical toothed wheel and wherein said chamfer in said second eye is formed so as to be inclined in a corresponding counterdirection.

7. An assembly according to claim 1 wherein said hinge pin and said second eye are provided with radially directed alternately arranged projections and recesses engaging in one another along a part of the length of said hinge pin and said second second hinge eye.

8. An assembly according to claim 1 wherein said engagement means comprise a flange formed on said hinge pin with said shaped portion comprising a collar formed on the upper side of said flange, said collar being configured with one of a crowned and spherical configuration, said complementary shaped portion of said second eye comprising a cup-shaped recess within which said spherical collar is fitted.

9. An assembly according to claim 8 wherein said hinge pin extends above said flange into a bore hole formed in said second eye, with the diameter of said portion of said hinge pin which extends above said flange being dimensioned to be smaller than the diameter of said bore hole by an amount providing play therebetween.

10. An assembly according to claim 1, wherein:

(a) said hinge pin is releasably connected with said first eye by means of a bushing composed of bearing material so as to be freely rotatable and maintentance-free and is secured against axial movement relative thereto;

(b) said hinge pin slidingly engages in said second eye unsecured in the axial direction by means of axially extending radially directed circumferential teeth, said second hinge eye having a corresponding counter shape; and (c) said two hinge members are locked with each other in the axial direction over a predetermined operational pivoting angular range by means of a projection and a recess which are reciprocally arranged in the circumferential direction and engaging in one another over said operational pivoting angular range of said hinge assembly.

11. An assembly according to claim 10 wherein a part of said hinge pin adjoining a cylindrical forward guide area and engaging in said second hinge eye is formed with an area provided with said circumferential teeth and said second hinge eye is formed with a correspondingly shaped bore hole.

12. An assembly according to claim 11 wherein said forward guiding area of said hinge pin has a smaller diameter than said bore hole in said second eye.

13. An assembly according to claim 10 wherein said projection is formed in one of said hinge members and wherein said recess is formed in the other of said hinge members outside the area of said hinge eye of said other hinge member, with said projection on said one hinge member being radially directed.

14. An assembly according to claim 10 wherein a grooved guide is formed in the other of said hinge members and is assigned with a radially directed projection arranged on the hinge eye of said one hinge member and extending along a part of the height of said one hinge member and enclosing an angle with said other hinge member.

15. An assembly according to claim 10 wherein said recess is formed as a radial recess formed in one of said hinge members and wherein said projection is a radially directed projection arranged on the hinge eye of the other hinge member which is firmly fastened on a motor vehicle, said projection enclosing an angle with said other hinge member.

* * * * *